US010890366B2

(12) United States Patent
Dieckmann

(10) Patent No.: US 10,890,366 B2
(45) Date of Patent: Jan. 12, 2021

(54) SYSTEMS AND METHODS FOR MAKING ICE

(71) Applicant: TIAX LLC, Lexington, KY (US)

(72) Inventor: John Dieckmann, Lexington, MA (US)

(73) Assignee: TIAX, LLC, Lexington, MA (US)

( * ) Notice: Subject to any disclaimer, the term of this patent is extended or adjusted under 35 U.S.C. 154(b) by 126 days.

(21) Appl. No.: 16/161,756

(22) Filed: Oct. 16, 2018

(65) Prior Publication Data

US 2020/0116408 A1 Apr. 16, 2020

(51) Int. Cl.
*F25C 1/12* (2006.01)
*F25B 39/02* (2006.01)
*F25B 5/02* (2006.01)

(52) U.S. Cl.
CPC ..... *F25C 1/12* (2013.01); *F25B 5/02* (2013.01); *F25B 39/028* (2013.01); *F25B 2339/0446* (2013.01)

(58) Field of Classification Search
CPC ..... F25C 1/12; F25C 5/10; F25C 5/18; F25C 5/20; F25C 2400/06; F25B 5/02; F25B 39/028; F25B 2339/0446; F25B 2313/02322; F25B 2313/02332; F25B 2400/19
USPC ..... 62/351
See application file for complete search history.

(56) References Cited

U.S. PATENT DOCUMENTS 4,442,681 A * 4/1984 Fischer ..... F25C 5/08 62/347
5,065,591 A * 11/1991 Shaw ..... F25B 5/02 62/175
10,041,706 B2 * 8/2018 Shin ..... F25B 30/02
2019/0154321 A1 * 5/2019 Takenaka ..... F25B 13/00

* cited by examiner

*Primary Examiner* — Edward F Landrum
*Assistant Examiner* — Joanna H Rosario
(74) *Attorney, Agent, or Firm* — Dinsmore & Shohl LLP; Weston R. Gould

(57) ABSTRACT

A cross-connected refrigeration system includes a first refrigeration subsystem and a second refrigeration subsystem that are fluidly coupled by a header, each of the first refrigeration subsystem and the second refrigeration subsystem including a refrigeration loop including a compressor, a condenser, an expansion device, and an evaporator, and a heating loop including an electrically-controlled valve, and the evaporator, and a header connection that connects the refrigeration loops and the heating loops of the first refrigeration subsystem and the second refrigeration subsystem to a common header, respectively. The compressor in the first refrigeration subsystem is selectively deactivated and the electrically-controlled valve in the first refrigeration subsystem is selectively opened such that compressed gas from the compressor in the second refrigeration subsystem enters the heating loop of the first refrigeration subsystem and heats the evaporator of the first refrigeration subsystem.

14 Claims, 9 Drawing Sheets

SYSTEMS AND METHODS FOR MAKING ICE

STATEMENT OF GOVERNMENT SPONSORSHIP

Portions of this invention were made with government support under contract no. W911QY-12-C-0057, awarded by the United States Army. The government has certain rights in the invention.

TECHNICAL FIELD

The present specification generally relates to systems and methods for producing and storing ice, and more specifically, to systems and methods for producing and storing ice using a refrigeration system with a cross-connected refrigerant header.

BACKGROUND

Among other things, ice is used in the preparation, storing, and service of food. Ice may also be used for medical purposes. Creating and storing ice can require large amounts of energy and large systems that occupy considerable space. Thus, in locations with high ambient temperatures and in applications with tight space considerations, ice making and storage may be complicated. Accordingly, systems and methods for making ice that reduce energy requirements and that are adaptable to tight spaces are required.

SUMMARY

In one embodiment, a cross-connected refrigeration system includes a first refrigeration subsystem and a second refrigeration subsystem that are fluidly coupled by a header, each of the first refrigeration subsystem and the second refrigeration subsystem including a refrigeration loop including a compressor, a condenser, an expansion device, and an evaporator, and a heating loop including an electrically-controlled valve, and the evaporator, and a header connection that connects the refrigeration loops and the heating loops of the first refrigeration subsystem and the second refrigeration subsystem to a common header, respectively. The compressor in the first refrigeration subsystem is selectively deactivated and the electrically-controlled valve in the first refrigeration subsystem is selectively opened such that compressed gas from the compressor in the second refrigeration subsystem enters the heating loop of the first refrigeration subsystem and heats the evaporator of the first refrigeration subsystem.

In another embodiment, a method of freezing and collecting a frozen substance using a cross-connected refrigeration system including a first refrigeration subsystem and a second refrigeration subsystem that are connected by a common header, includes compressing a refrigerant in the second refrigeration subsystem, deactivating a compressor in the first refrigeration subsystem, and opening an electrically-controlled valve in the first refrigeration subsystem such that compressed refrigerant from the second refrigeration subsystem enters an evaporator of the first refrigeration subsystem.

In yet another embodiment, a system for freezing and packaging a substance includes a cross-connected refrigeration system including a first refrigeration subsystem and a second refrigeration subsystem that are fluidly coupled by a header, each of the first refrigeration subsystem and the second refrigeration subsystem including a refrigeration loop including a compressor, a condenser, an expansion device, and an evaporator for freezing a substance, and a heating loop including an electrically-controlled valve, and the evaporator, and a header connection that connects the refrigeration loops and the heating loops of the first refrigeration subsystem and the second refrigeration subsystem to a common header, respectively. The compressor in the first refrigeration subsystem is selectively deactivated and the electrically-controlled valve in the first refrigeration subsystem is selectively opened such that compressed gas from the compressor in the second refrigeration subsystem enters the heating loop of the first refrigeration subsystem and heats the evaporator of the first refrigeration subsystem, and a package transfer system including an intake hopper attached to an opening of a bag, a conveyor, a lifting tray, and a pusher. The substance is positioned to drop from the evaporator into the bag attached to the intake hopper when frozen, the conveyor moves the bag to the lifting tray where the bag is lifted and pushed by the pusher into a storage freezer.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
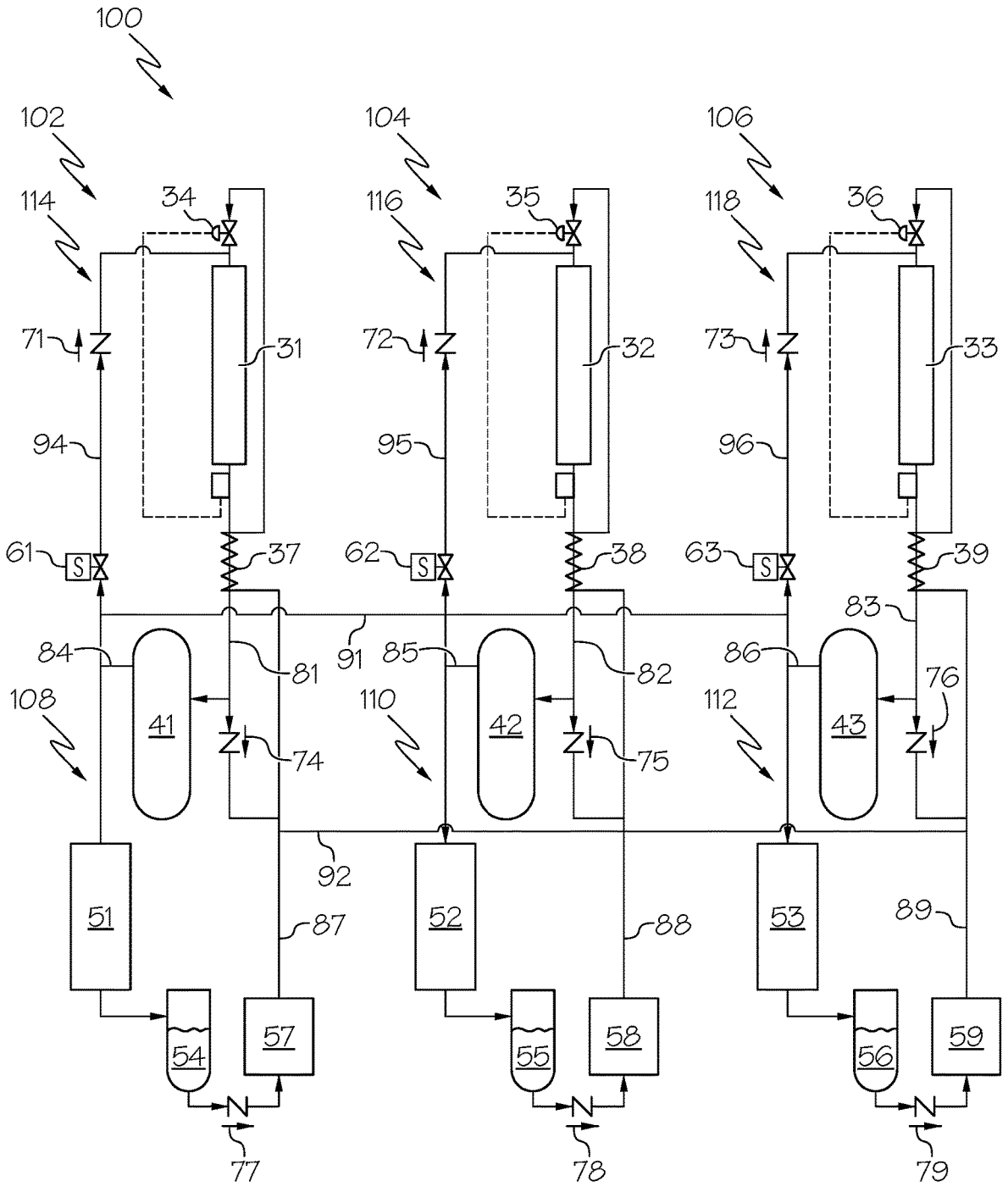
FIG. 1 depicts a schematic view of a cross-connected refrigeration system, according to one or more embodiments shown and described herein.

FIG. 1 generally depicts a cross-connected refrigeration system including multiple refrigeration subsystems, each including a refrigeration loop including a compressor, a condenser, an expansion device, and an evaporator, and a heating loop including an electronically-controlled valve and the evaporator. A header connection cross connects the refrigeration loop and the heating loop of the multiple refrigeration subsystems at a common header as described in greater detail below. The cross connection between the various refrigeration subsystems increases the efficiency of the refrigeration system by reducing the duty cycle of the compressor of each of the refrigeration subsystems as discussed in greater detail below.

One type (i.e., shape) of commercially-produced ice is commonly referred to as a "cube." The machines that produce such ice are colloquially known as "cubers" or "cuber-type" ice machines. In a cuber-type ice machine, water is flowed over a freezing surface that is refrigerated (e.g., using an evaporator of a refrigeration system) to a temperature below the freezing point of water. A layer of ice builds up on this surface, until the ice reaches a desired thickness. Upon reaching the desired thickness, refrigeration is stopped and the freezing surface is heated above the melting temperature of water to melt a thin layer of the ice in contact with the freezing surface, releasing the rest of the ice, which then falls off the surface into a storage area (e.g., a bag or an insulated storage bin). The portion of the process in which the ice is released from the freezing surface is commonly referred to as "harvesting".

The freezing surface of the cuber-type ice machine may take any geometric shape and is generally cooled below the freezing temperature of water by introducing refrigerant to one or more closed refrigeration loops in thermal communication with the freezing surface. Cooling of the refrigerant is commonly achieved by evaporating the coolant in an evaporator. Hence, the assembly of freezing surface and refrigeration loops may be referred to as the evaporator.

As the refrigerant evaporates, the refrigerant vapor is drawn away by a refrigerant compressor (or simply, "compressor"), which compresses the refrigerant vapor, after which the compressed vapor flows into a condenser (which may be either air of water cooled) where the refrigerant is condensed to liquid. The condensed liquid is then returned to the evaporator via expansion device, continuing the process.

In some cuber-type ice machines, heat for harvesting may be provided by hot gas phase refrigerant from a compressor discharge of the compressor. The hot gas phase refrigerant may heat the external surface above the melting temperature of water as descried above. In some embodiments, the hot gas may be selectively applied to the freezing surface by opening and closing an electrically-operable, selectively openable valve such as a solenoid valve. Opening the solenoid valve may send hot gas from the compressor discharge to the refrigerant passages in the evaporator. When the selectively openable valve is open, the hot gas phase refrigerant, or a portion thereof, from the compressor discharge may not cycle through the refrigeration loop because it is selectively fed to the evaporator through the selectively openable valve. This may reduce the efficiency of the refrigeration process.

During the freezing process, the energy consumed to operate the refrigerant compressor is usefully supplying the cooling needed to freeze the ice. During the hot gas harvest cycle the compressor continues to run and to consume energy, but little or none of that consumed energy is used to freeze water on the freezing surface of the evaporator. This may result in an increase in energy consumption by approximately 10%.

Referring now to FIG. 1, a cross-connected refrigeration system including two or more interconnected refrigeration subsystems is shown. The interconnected refrigeration subsystems may operate sequentially, so that the hot gas that is needed to harvest the ice that has been frozen by one refrigeration subsystem is provided by the compressor discharge gas from the other one or more refrigeration subsystems that are operating to freeze ice. Accordingly, the compressor of each refrigeration subsystem need not run when ice is being harvested from the evaporator in the same refrigeration subsystem, thus improving system efficiency.

FIG. 1 is an exemplary schematic of a cross-connected refrigeration system 100. The cross-connected refrigeration system 100 of FIG. 1 includes refrigeration subsystems 102, 104, 106.

Each refrigeration subsystem includes a refrigeration loop 108, 110, 112. The refrigeration loop 108, 110, 112 includes: a compressor 41, 42, 43; a condenser 51, 52, 53; an expansion device 34, 35, 36; and an evaporator 31, 32, 33. The compressor 41, 42, 43 may include a discharge tube 84, 85, 86 and a suction line 81, 82, 83. The refrigeration subsystem 102, 104, 106 may also include a heating loop 114, 116, 118. The heating loop 114, 116, 118 includes an electrically-controlled valve 61, 62, 63 and the evaporator 31, 32, 33. A header connection cross connects the compressor 41, 42, 43 and/or the discharge tubes 84, 85, 86 with the heating loops 114, 116, 118 through a common header 91 such that the refrigeration loops 108, 110, 112 are cross connected with the heating loops 114, 116, 118 as explained in greater detail herein. Additionally, a common manifold 92 cross connects the outlets of each condenser 51, 52, 53.

In some embodiments, the refrigeration loop 108, 110, 112 may include a receiver 54, 55, 56. Additionally, in some embodiments, the refrigeration loop 108, 110, 112 may include a subcooler 57, 58, 59. Additionally, in some embodiments, the refrigeration loop 108, 110, 112 may include an interchanger 37, 38, 39. Each of the heating loops 114, 116, 118 may include a heating loop check valve 71, 72, 73 and each of the refrigeration loops 108, 110, 112 may include a refrigeration loop check valve 77, 78, 79. Each of the refrigeration subsystems 102, 104, 106 may further include a common manifold gas check valve 74, 75, 76 for preventing the flow of liquid from the common manifold 92 to the refrigeration loop 102, 104, 106. The setpoints of the heating loop check valves 71, 72, 73 and the refrigeration loop check valves 77, 78, 79 may be related to cause refrigerant to preferentially flow to the evaporators 31, 32, 33 when the electrically-controlled valves 61, 62, 63 cycle to melt ice from the evaporators 31, 32, 33 as will be described in greater detail herein.

As mentioned, each refrigeration subsystem 102, 104, 106 includes the evaporator 31, 32, 33. For convenience of description, only one refrigeration subsystem will be described where such description is applicable to each of the refrigeration subsystems below.

When the refrigeration subsystem 102 is in ice freezing mode (i.e., building layers of cubed ice on an exterior surface of the evaporator 31), the flow of refrigerant through the refrigeration subsystem is from the compressor 41 to a discharge tube 84, to the condenser 51, to the receiver 54 (optionally), to the refrigeration loop check valve 77, to the subcooler 57 (optionally), to the interchanger 37 (optionally), to the expansion device 34, to the evaporator 31, to the interchanger 37 (optionally), to the suction line 81 and back to the compressor 41.

Refrigerant vapor is compressed in the compressor 41 and the vapor is condensed to liquid in the condenser 51.

Condensation of the refrigerant rejects heat from the refrigeration subsystem to an external system or ambient atmosphere. Refrigerant liquid passes through the expansion device 34 and into the evaporator 31 where it absorbs the latent heat of vaporization (LHV) and vaporizes, removing heat from the water flowing over the exterior surface (not shown) of the evaporator 31. When the refrigerant absorbs sufficient heat to reduce the temperature of the water below its freezing temperature (e.g., 0 degrees Centigrade at 1 atmosphere of pressure), the water freezes on the external surface of the evaporator 31. In some embodiments, a portion of the refrigerant flow into discharge tube 84 may flow to common header 91 and a portion of the liquid flow in liquid line 87 may flow into common manifold 92. In embodiments, a portion of the refrigerant liquid flow in liquid line 87 may flow in from common manifold 92. The flow of refrigerant in the other two refrigeration subsystems 104, 106 is substantially the same when in an ice freezing mode.

During the ice freezing mode, water that contacts the external surface (not shown) of the evaporator 31 is in thermal communication with the refrigerant flowing in the one or more channels of the evaporator 31 such that the refrigerant removes heat from the water, causing the water to freeze on the external surface of the evaporator 31. As the water freezes on the external surface, the thickness of the ice may continue to increase ("layering"). The ice layers until it reaches a desired thickness. The desired thickness may be set using a control system and the thickness of the ice may be measured by any type of sensor as is commonly known in the art (e.g., a proximity sensor, a laser sensor, a scale measuring the weight of the ice, etc.). Upon reaching the desired thickness, harvesting may be initiated.

During harvesting, relatively warm refrigerant (i.e., above the freezing temperature of water) may be introduced to the channels of the evaporators 31 causing the layer on the external surface of the evaporator 31 to melt, releasing the layer of ice from the external surface of the evaporator 31 and into a storage bin.

When the layer of ice on the evaporator 31 reaches the desired thickness, the compressor 41 may decrease the speed at which it is operating or may stop operating completely. Additionally, the electrically-controlled valve 61 may be opened. During operation of the compressors 41, 42, 43, relatively hot gas (i.e., above the melting temperature of water) from the outlet of the compressors 41, 42, 43 enters the common header 91 through the discharge tubes 84, 85, 86. When ice from the evaporator 31 is harvested, the compressors 42, 43 may continue to operate and relatively hot gas from the common header 91 passes through the electrically-controlled valve 61 and the heating loop check valve 71 into the hot gas line 94. The hot gas line 94 feeds into the evaporator downstream of the expansion device 34, between the expansion device 34 and the evaporator 31. Relatively hot gas enters the evaporator 31 through the hot gas line 94 and melts a thin portion of the ice layer on the evaporator 31 by a combination of desuperheating and condensing, melting a thin film of water, releasing the ice, allowing it to fall off the evaporator 31 into, for example, a storage bin or the intake hopper of an ice bagging system. The contained ice may be moved to another location for storage as described in greater detail herein.

Condensed liquid leaves the evaporator 31 via suction line 81, then passes through common manifold gas check valve 74 into common manifold 92. During this process, the entire loop just described is operating at the pressure in common header 91, which is approximately 10 psi higher than common manifold 92 as described in greater detail herein. The differential pressure provides the necessary driving force to cause liquid refrigerant to flow through common manifold gas check valve 74 and into common manifold 92. Harvesting mode may last, for example, 1 to 2 minutes. While the refrigeration subsystem 102 is in harvesting mode, other refrigeration subsystems (e.g., the refrigeration subsystems 104, 106) may continue to operate in freezing mode such that the compressors 42, 43 supply the relatively hot gas flow into common header 91 and through the electrically-controlled valve 61 to the evaporator 31. Thus, generally, hot gas for harvest is supplied by the compressed discharge gas from the compressors of other refrigeration subsystems that are operating in freeze mode. This may inhibit wasting energy to harvest ice using the compressor 41.

In some embodiments, water in contact with the external surface of the evaporator 31 may be precooled by a separate water precooler in a water precooling refrigeration loop. The separate water precooler may operate at a higher evaporating temperature and coefficient of performance ("COP") than the main ice freezing refrigeration loop. The separate water precooler may subcool the liquid refrigerant from the condenser before it goes to the expansion device and on to the evaporator 31. This may shift additional cooling load to a higher evaporating temperature.

In some embodiments, the operation of the various refrigeration subsystems may be staggered. For example, a control system may be used to control the timing of operation of the various refrigeration subsystems. The control system may control the timing of the operation of the various refrigeration subsystems such that no more than one refrigeration subsystem is in harvest mode concurrently. In some embodiments, the control system may control the timing of the operation of the various refrigeration subsystems such that no more than two refrigeration subsystems are in harvest mode concurrently. In some embodiments, the control system may further automatically initiate ice making by activating a valve (e.g., a solenoid valve) that allows water to fill a sump of evaporator 31 to a preset level. The control system may also activate a water circulation pump to cause water to flow from the sump over the external surface of the evaporator 31. In some embodiments, the control system may also automatically activate the compressors 41 42, 43, causing refrigerant to cycle through the refrigeration loops 108, 110, 112. In some embodiments, the control means may automatically terminate operation of one or more of the refrigeration subsystems based on the level in the sump. In some embodiments, residual water may automatically drain from the sumps after a specified number of ice making cycles by activating a solenoid valve that allows the water to drain out of the sump. In some embodiments, a drain pump may automatically remove any water that has been drained from the sumps or from an automatic baggage system discussed in greater detail herein.

In embodiments, the control system may automatically detect when the harvest is completed and commence the next ice cycle based on completion of the harvest. Further, the control system may automatically maintain the sequence of activation of the refrigeration subsystems, such that the ice making and harvesting cycles are staggered evenly between refrigeration subsystems and only one refrigeration subsystem is in a harvest cycle at any given time. This may be done by setting a minimum time interval between the time when one refrigeration subsystem begins an ice making cycle and when subsequent refrigeration subsystems begin an ice making cycle. This time interval may be adjusted, based on the actual time to produce and harvest the ice. In some embodiments, the time interval may be automatically and/or continuously adjusted as the cross-connected refrigeration system operates. In some embodiments, the control system may automatically impose a shutdown process or sequence that may automatically begin upon an operator command. The shutdown sequence may cause batches of ice that are already in process to complete their cycle such that all of the ice that produced is bagged and transferred to an external storage unit as described in greater detail herein. In some embodiments, the control system may activate indicator lights that show the status of each evaporator 31 and of the baggage system described in greater detail herein.

In embodiments, the control system may automatically control the capacity of the compressor (e.g., in embodiments in which the compressor is a variable capacity compressor).

The pressure of the heating loop 114, 116, 118 and the common header 91 may be maintained above the pressure of the common manifold 92 by controlling the relief valve differential setpoints of the heating loop check valves 71, 72, 73 and the common manifold gas check valves 74, 75, 76 below the differential setpoints of the refrigeration loop check valves 77, 78, 79. Heating loop check valves 71, 72, and 73 and common manifold gas check valves 74, 75, 76 may have relatively low differential setpoints (i.e., the pressure differential needed across the check valve to open the check valve in the allowed direction of flow). Refrigeration loop check valves 77, 78, and 79 may have relatively higher differential setpoints (e.g., approximately 10 psi), to establish the pressure of the common manifold 92 (which generally contains liquid refrigerant) approximately 10 psi below the pressure of the common header 91.

Figure 2:
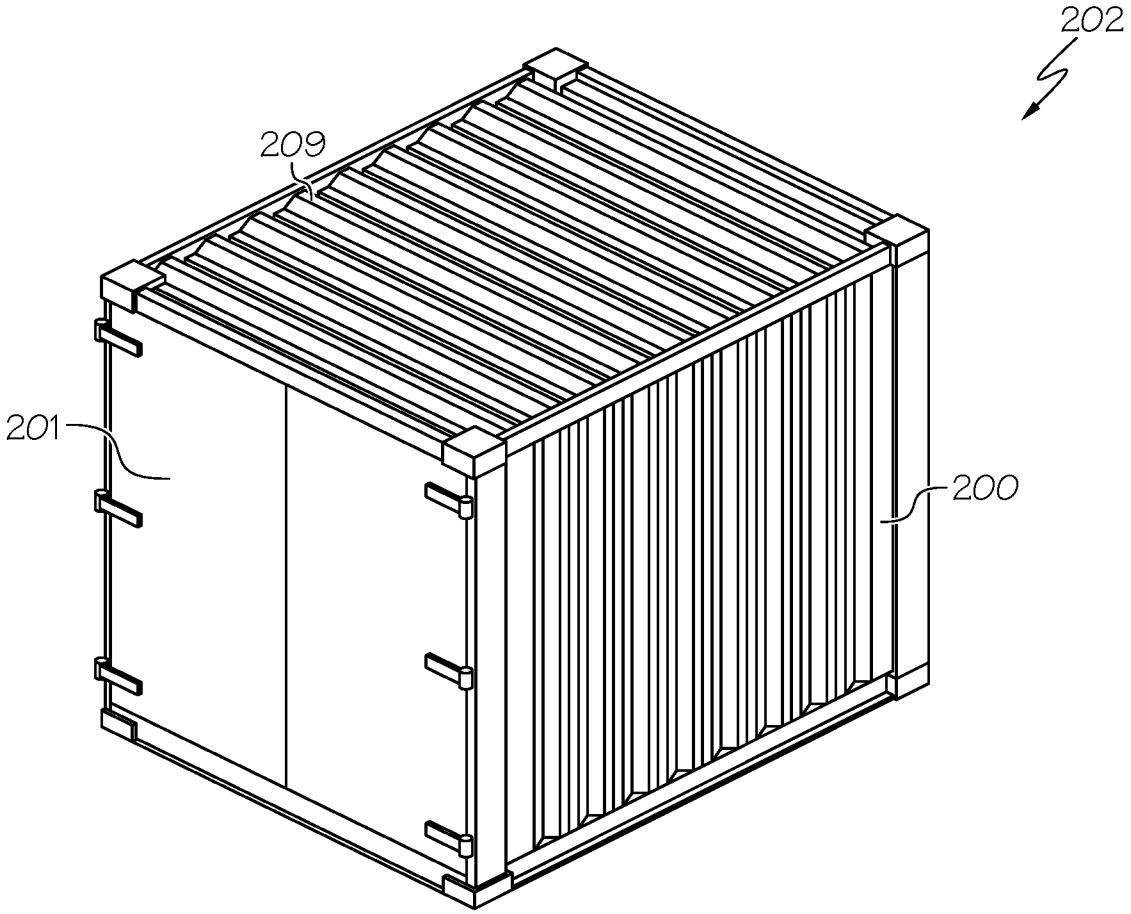
FIG. 2 depicts a container for housing a cross-connected refrigeration system, according to one or more embodiments shown and described herein.

Referring now to FIG. 2, a large capacity, portable ice making system 200 is shown. The ice making system 200 may be packaged in a shipping container 202. When in use, an ice making unit 204 (FIG. 4) (e.g., the cross-connected refrigeration system 100 of FIG. 1) may pull most of the way out of the shipping container 202. The interior of the shipping container 202 may be insulated. In some embodiments, bagged ice from the ice making unit 204 may be stored in an interior 206 (FIG. 6) of the shipping container 202. The interior 206 may be a freezer storage volume for the bagged ice. In some embodiments, the shipping container may serve as a storage container for food that is required to be refrigerated (e.g., frozen food). Referring to FIGS. 2-6, the ice making system 200 is described. FIG. 2, shows the containerized ice machine fully contained within the shipping container 202. The shipping container 202 may be a standard shipping container (e.g., a "Tricon" shipping container, which is an ISO shipping container that is one third the length of a standard 20 foot ISO container). While the particular embodiment shown in FIGS. 2-6 illustrates a Tricon shipping container, it is to be understood that any type of shipping container 202 could be used. The shipping container 202 may include an exterior shell made from metal or durable plastic.

Figure 3:
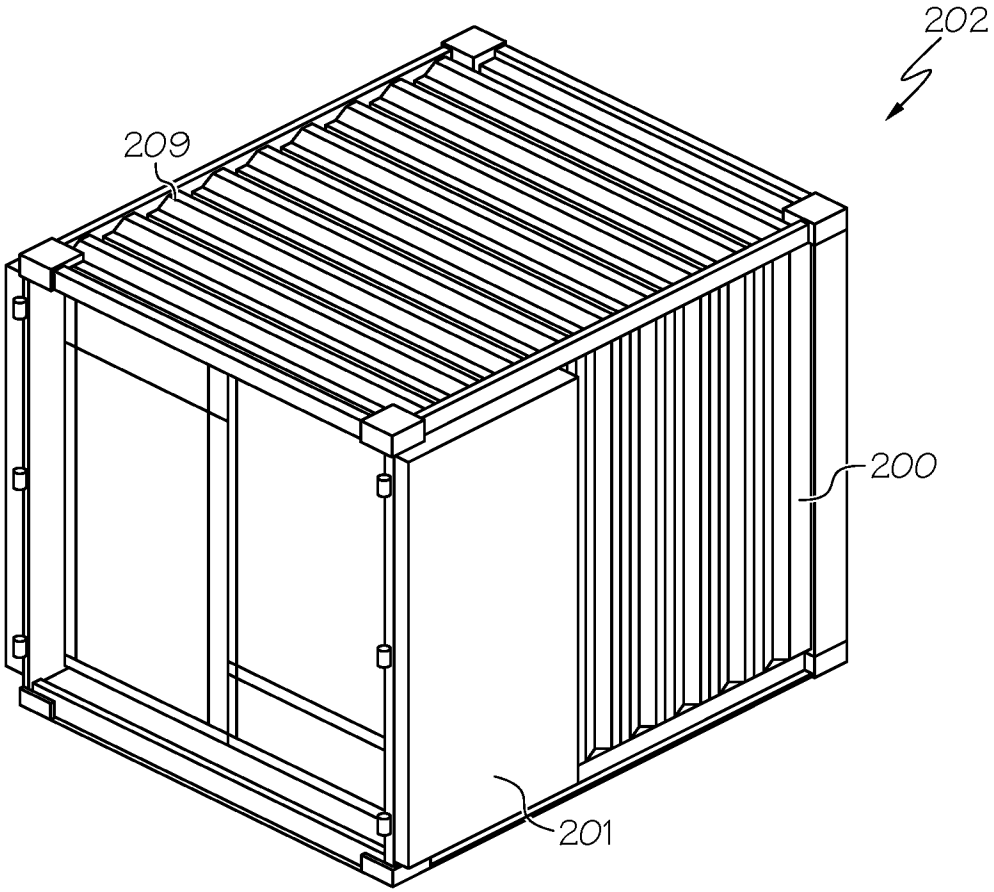
FIG. 3 depicts the container for housing a cross-connected refrigeration system, according to one or more embodiments shown and described herein.
Figure 4:
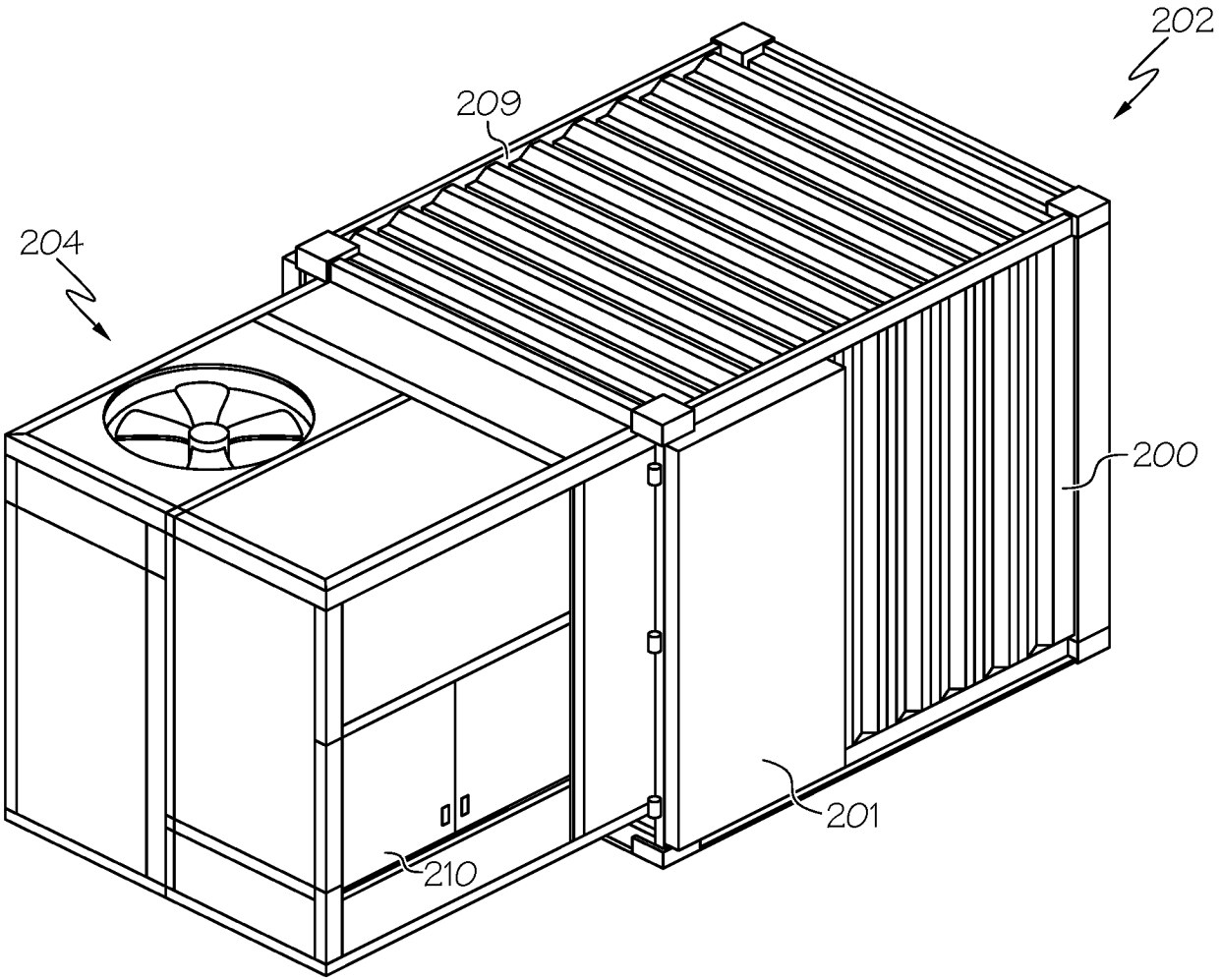
FIG. 4 depicts the container for housing a cross-connected refrigeration system with the cross-connected refrigeration system in an external position, according to one or more embodiments shown and described herein.
Figure 5:
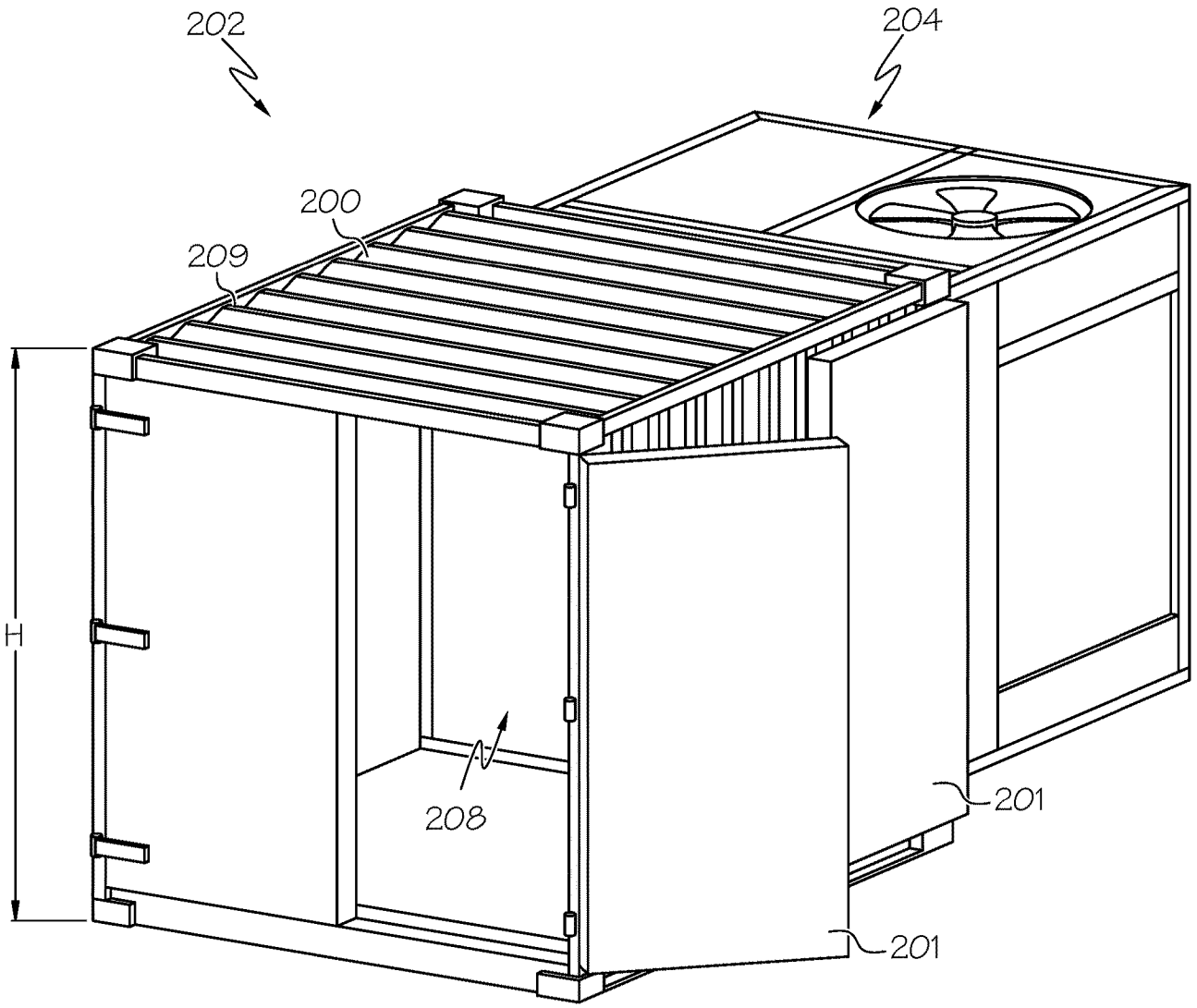
FIG. 5 depicts the container for housing a cross-connected refrigeration system with the cross-connected refrigeration system in an external position and a storage area for storing one or more bags of ice in a storage configuration, according to one or more embodiments shown and described herein.

As shown in FIGS. 3, 4, and 5, the shipping container 202 may include doors 201. The doors 201 may isolate the ice making unit 204 from the outside. The ice making unit 204 may be sized to fit in and out of the shipping container 202 through the doors 201. With reference to FIGS. 4 and 5, the ice making unit 204 may be removed from the shipping container 202 into an operating position for making ice using the ice making unit 204. In some embodiments, the ice making unit 204 may slide out of the shipping container 202 through a front (as shown in FIG. 4) or a back (as shown in FIG. 5).

In the operating position, one or more of the walls 209 and the doors 201 may include an insulating material. In some embodiments, the insulating material may be a foam insulation such as polyurethane, or the like. For example, the walls 209 and doors 201 may be lined with a two-inch thick polyurethane foam insulation. In some embodiments, a height H (FIG. 5) of the shipping container 202 may be such that a person of average height can fit comfortably within the shipping container 202. For example, the shipping container 202 may be a "walk-in freezer." In some embodiments, the shipping container 202 is fitted with one or more vents for venting the interior 206 to the outside such that air and other gasses may enter the interior 206.

Figure 6:
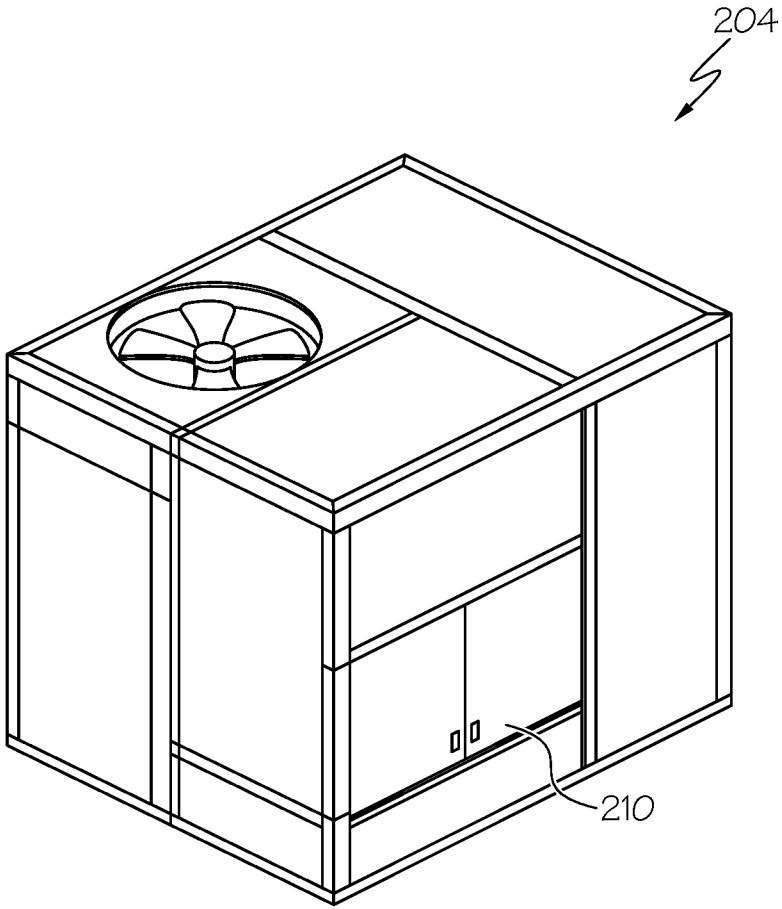
FIG. 6 depicts an illustrative embodiments of the cross-connected refrigeration system, according to one or more embodiments shown and described herein.

Referring to FIG. 6, in some embodiments, the ice making unit 204 may include access doors 210 that permit access to internal components of the ice making unit 204. For example, the ice making unit 204 may include internal components such as the components described above with respect to the cross-connected refrigeration system 100 of FIG. 1. In such embodiments, the access doors 210 may permit access to one or more of the components of the cross-connected refrigeration system 100. For example, the access doors 210 may permit access to install, maintain, or remove one or more components of the cross-connected refrigeration system 100, such as the electrically-controlled valve 61, 62, 63 of FIG. 1. In some embodiments, the access doors 210 may permit access to install one or more bags to be used in an automatic ice bagging unit, as described in greater detail herein.

Figure 7:
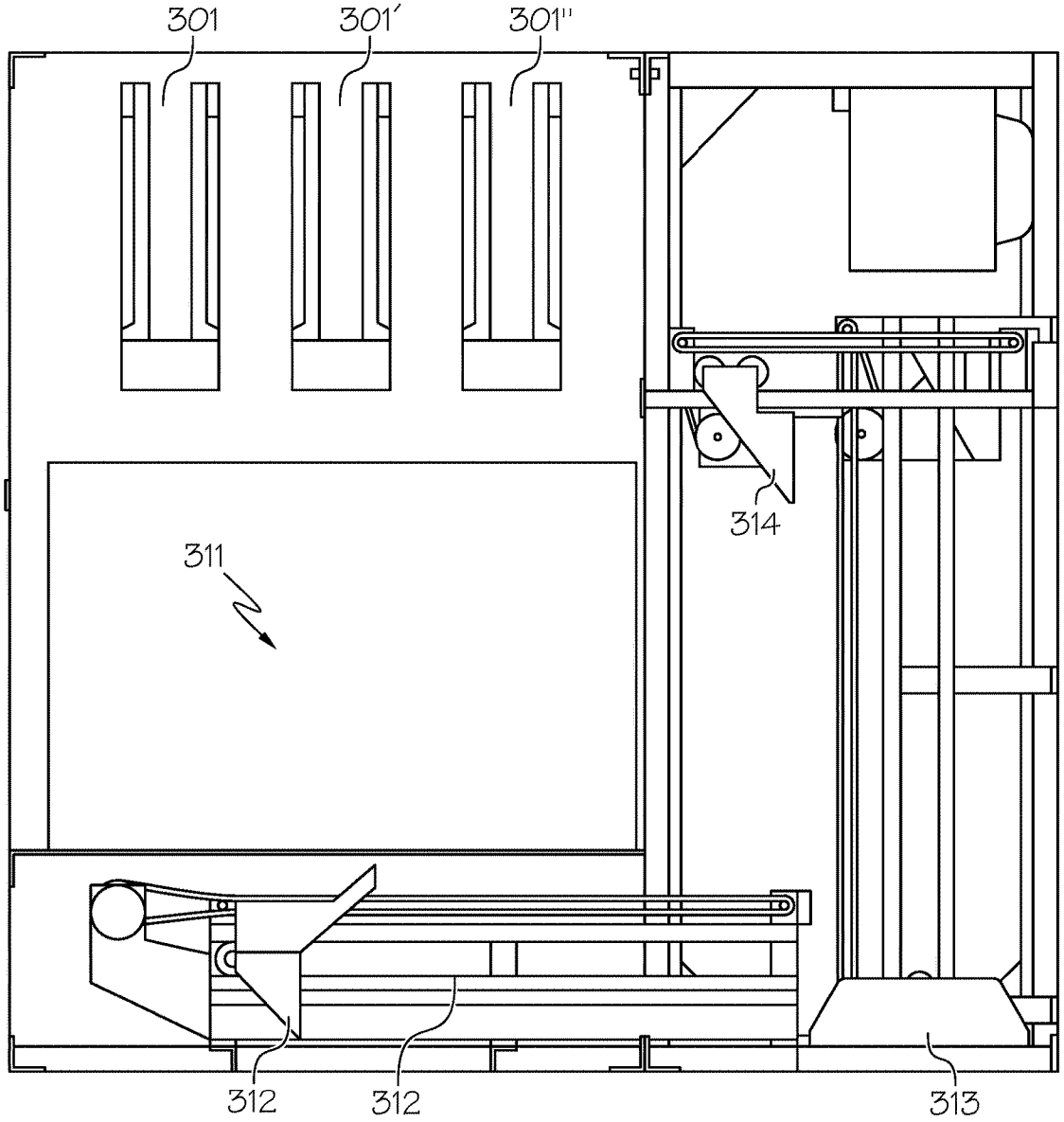
FIG. 7 depicts a side view of a bagged ice transfer system, according to one or more embodiments shown and described herein.
Figure 8:
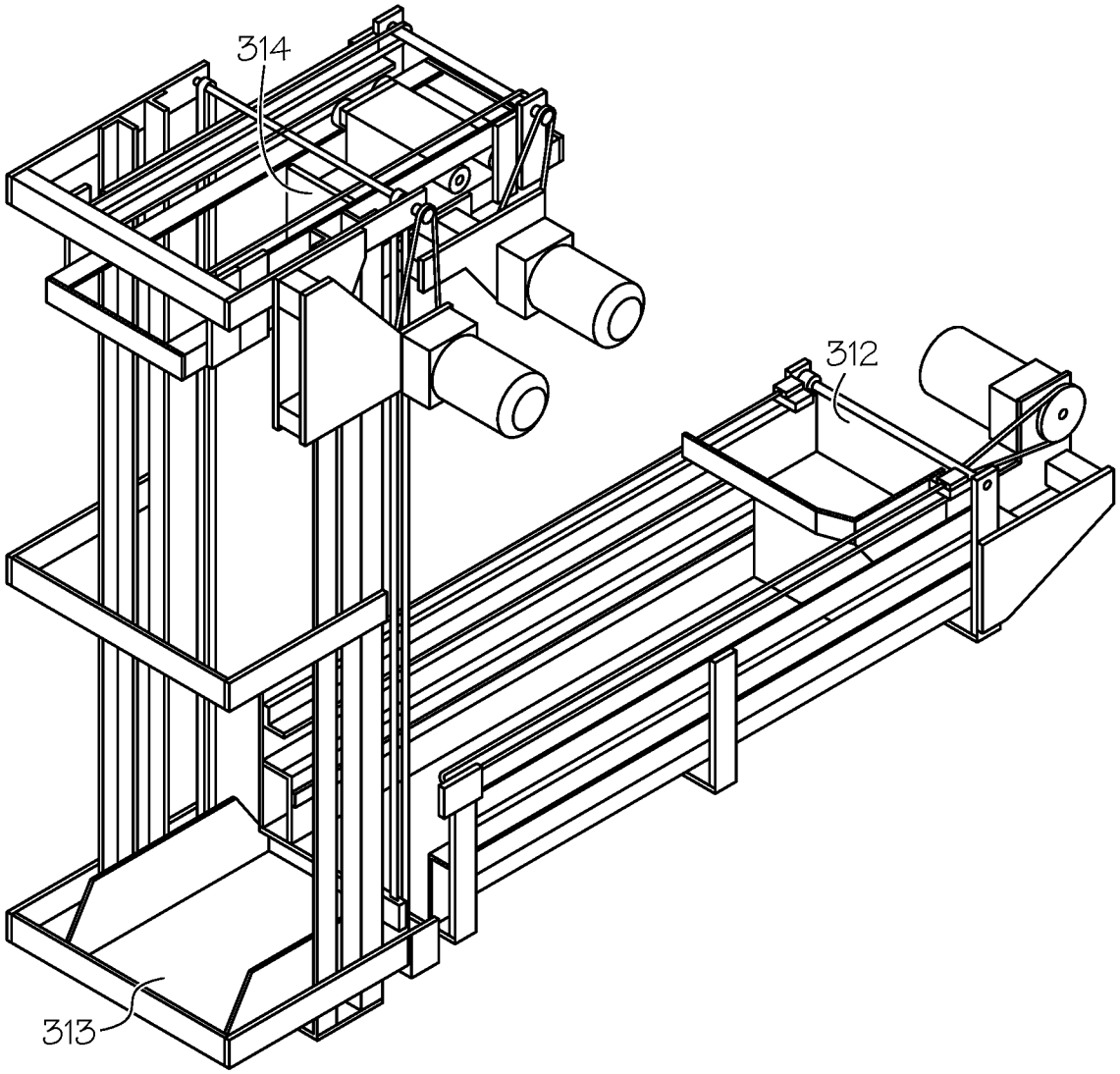
FIG. 8 depicts the bagged ice transfer system of FIG. 8, according to one or more embodiments shown and described herein.
Figure 9:
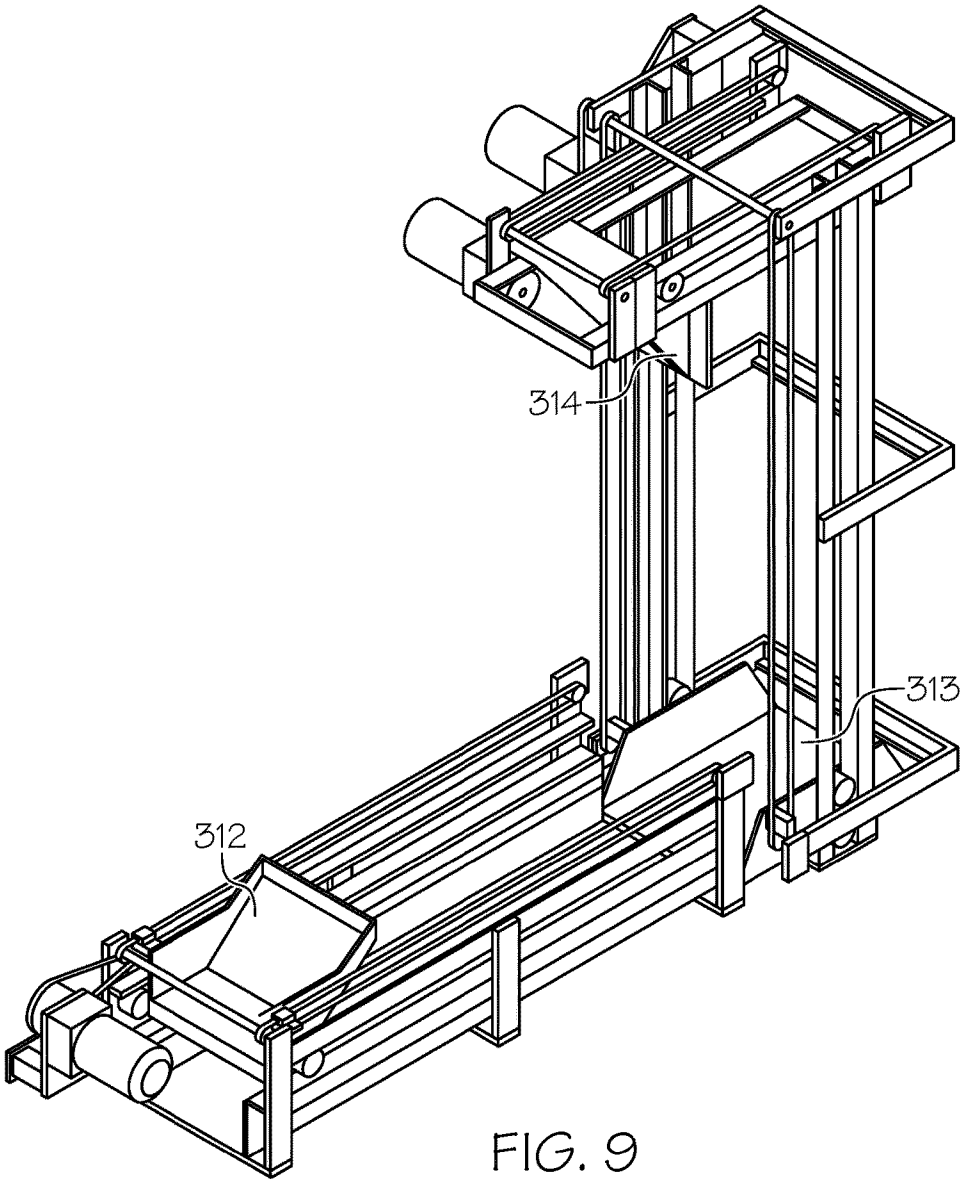
FIG. 9 depicts the bagged ice transfer system of FIGS. 8 and 9, according to one or more embodiments shown and described herein.

Referring now to FIG. 7, a bagged ice transfer system 300 is shown. In some embodiments, the bagged ice transfer system 300 may be used to bag and transfer ice from an ice making system (e.g., the cross-connected refrigeration system 100 of FIG. 1) to a storage space (e.g., the shipping container 202 of FIGS. 2-6).

The bagged ice transfer system 300 may automatically bag ice produced by an ice making system and transfer the bagged ice to a storage area using an automatic bagging system 311. The ice may be produced on an evaporator 301 (e.g., the evaporator 31 of the cross-connected refrigeration system 100 of FIG. 1). The produced ice may be transferred from the evaporator 301 to an intake of the automatic bagging system 311. For example, in some embodiments, the produced ice may fall by gravity to an intake hopper of an automatic bagging system.

Bagged ice may be transferred to a conveyor of the baggage system 311, such as the conveyor 312. The conveyor 312 may transfer the bagged ice to a lifting tray 313. The lifting tray 313 may lift the bagged ice into alignment with a pusher 314. The pusher 314 may push the bag of ice horizontally until the bag of ice passes through an opening into a storage area (e.g., the storage area 208 of the shipping container 202 of FIGS. 2-6). The ice making system may continue to produce ice and the bagged ice transfer system 300 may continue to transfer ice to the storage area without any user input. Embodiments may further include an agitation auger that prevents ice from clumping together in an intake hopper of the automatic bagging system 311.

It is noted that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. As used herein, the term "and/or" includes any and all combinations of one or more of the associated listed items. It will be further understood that the terms "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A cross-connected refrigeration system comprising:

a first refrigeration subsystem and a second refrigeration subsystem that are fluidly coupled by a header, each of the first refrigeration subsystem and the second refrigeration subsystem comprising:

a refrigeration loop comprising:

a compressor, a condenser, an expansion device, and an evaporator; and a heating loop comprising: an electrically-controlled valve, and the evaporator; and a header connection that connects the refrigeration loops and the heating loops of the first refrigeration subsystem and the second refrigeration subsystem to a common header, respectively, wherein the compressor in the first refrigeration subsystem is configured to be selectively deactivated and the electrically-controlled valve in the first refrigeration subsystem is configured to be selectively opened such that compressed gas from the compressor in the second refrigeration subsystem enters the heating loop of the first refrigeration subsystem and heats the evaporator of the first refrigeration subsystem.

2. The cross-connected refrigeration system of claim 1, wherein the evaporator comprises a refrigeration system side and an external side and the external side is in thermal communication with water.

3. The cross-connected refrigeration system of claim 2, wherein the compressor and the electrically-controlled valve in either of the first refrigeration subsystem or the second refrigeration subsystem deactivate and open, respectively, based on an amount of ice formed by the evaporator of the first refrigeration subsystem and the second refrigeration subsystem.

4. The cross-connected refrigeration system of claim 1, wherein:

the heating loops of both of the first refrigeration subsystem and the second refrigeration subsystem include a heating loop check valve; and the refrigeration loops of both of the first refrigeration subsystem and the second refrigeration subsystem include a refrigeration loop check valve, wherein the heating loop check valves have a lower opening setpoint than the refrigeration loop check valves.

5. The cross-connected refrigeration system of claim 1, wherein:

the refrigeration loops in both of the first refrigeration subsystem and the second refrigeration subsystem include a receiver and a subcooler.

6. The cross-connected refrigeration system of claim 1, wherein a liquid manifold couples the refrigeration loops of the first refrigeration subsystem and the second refrigeration subsystem.

7. The cross-connected refrigeration system of claim 1, wherein the electrically-controlled valve in the first refrigeration subsystem and the second refrigeration subsystem is a solenoid-controlled valve.

8. The cross-connected refrigeration system of claim 1, wherein the refrigeration loop in any of the first refrigeration subsystem and the second refrigeration subsystem includes an interchanger.

9. A system for freezing and packaging a substance comprising:

a cross-connected refrigeration system comprising:

a first refrigeration subsystem and a second refrigeration subsystem that are fluidly coupled by a header, each of the first refrigeration subsystem and the second refrigeration subsystem comprising:

a refrigeration loop comprising:

a compressor, a condenser, an expansion device, and an evaporator for freezing a substance;

and a heating loop comprising:

an electrically-controlled valve, and the evaporator; and a header connection that connects the refrigeration loops and the heating loops of the first refrigeration subsystem and the second refrigeration subsystem to a common header, respectively, wherein the compressor in the first refrigeration subsystem is configured to be selectively deactivated and the electrically-controlled valve in the first refrigeration subsystem is configured to be selectively opened such that compressed gas from the compressor in the second refrigeration subsystem enters the heating loop of the first refrigeration subsystem and heats the evaporator of the first refrigeration subsystem, and a package transfer system including:

an intake hopper attached to an opening of a bag;

a conveyor;

a lifting tray;

and a pusher, wherein the substance is configured to be positioned to drop from the evaporator into the bag attached to the intake hopper when frozen, and the conveyor moves the bag to the lifting tray where the bag is lifted and pushed by the pusher into a storage freezer.

10. The system of claim 9, wherein the cross-connected refrigeration system and the package transfer system are housed in a container.

11. The system of claim 10, wherein the cross-connected refrigeration system is selectively positionable outside of the container.

12. The system of claim 11, wherein when the cross-connected refrigeration system is positioned outside the container, the package transfer system moves the bag into a void left by the cross-connected refrigeration system in the container.

13. The system of claim 10, wherein the container includes an exterior shell that is lined with an insulating material.

14. The system of claim 13, wherein the insulating material is polyurethane foam.

* * * * *